US007976589B1

(12) United States Patent
Bunker

(10) Patent No.: US 7,976,589 B1
(45) Date of Patent: Jul. 12, 2011

(54) CHEMICAL DEOXYGENATION OF HYDROCARBON LIQUIDS USING TEMPERATURE TRIGGERABLE REACTIVE CORE-SHELL MATERIALS

(75) Inventor: Christopher E. Bunker, Kettering, OH (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 655 days.

(21) Appl. No.: 11/434,580

(22) Filed: May 4, 2006

Related U.S. Application Data

(60) Provisional application No. 60/680,380, filed on May 12, 2005.

(51) Int. Cl.
*C10L 9/08* (2006.01)
*C10L 9/10* (2006.01)

(52) U.S. Cl. ..... 44/354; 44/329

(58) Field of Classification Search ..... 428/407, 428/402; 44/329, 354; 156/272.4
See application file for complete search history.

(56) References Cited

U.S. PATENT DOCUMENTS

| | | | | |
|---|---|---|---|---|
| 5,186,993 | A * | 2/1993 | Hallden-Abberton et al. | 428/36.92 |
| 5,362,783 | A | 11/1994 | Eiffler et al. | |
| 5,382,266 | A | 1/1995 | Lin et al. | |
| 5,509,944 | A | 4/1996 | Venkatadri et al. | |
| 6,475,252 | B1 | 11/2002 | Heneghan et al. | |
| 2003/0096880 | A1 * | 5/2003 | Wang et al. | 518/714 |
| 2005/0160662 | A1 * | 7/2005 | Jordan | 44/329 |
| 2005/0227077 | A1 * | 10/2005 | Sugiyama | 428/407 |
| 2006/0102519 | A1 * | 5/2006 | Tonkovich et al. | 208/107 |
| 2007/0202333 | A1 * | 8/2007 | O'Brien et al. | 428/402 |
| 2008/0308222 | A1 * | 12/2008 | Sauer et al. | 156/272.2 |

OTHER PUBLICATIONS

K.S. Suslick, M. Fang and T. Hyeon, "Sonochemical Synthesis of Iron Colloids", *J. Am. Chem. Soc.*, 1996, pp. 11960-11960, vol. 118.
G. Kataby, M. Cojocaru, R. Prozorov and A. Gedanken, "Coating Carboxylic Acides on Amorphous Iron Nanoparticles", *Langmuir*, 1999, pp. 1703-1708, vol. 15.

* cited by examiner

*Primary Examiner* — Michael A Marcheschi
*Assistant Examiner* — Chantel Graham
(74) *Attorney, Agent, or Firm* — AFMCLO/JAZ; Bart S. Hersko

(57) ABSTRACT

Nanoscopic core-shell material additives for high temperature jet aviation fuels are disclosed. The nanometer dimensions of these core-shell material additives materials provide extremely large surface areas to promote chemical reactivity while permitting suspension in liquid fuels and providing unlimited access to all components of an aircraft fuel system. Core-shell technology involves additive encapsulation in a protective, fuel-mimicking shell material.

2 Claims, 4 Drawing Sheets

CHEMICAL DEOXYGENATION OF HYDROCARBON LIQUIDS USING TEMPERATURE TRIGGERABLE REACTIVE CORE-SHELL MATERIALS

CROSS-REFERENCE TO RELATED APPLICATION

This application claims the benefit of U.S. Ser. No. 60/680,380 filed May 12, 2005.

RIGHTS OF THE GOVERNMENT

The invention described herein may be manufactured and used by or for the Government of the United States for all governmental purposes without the payment of any royalty.

BACKGROUND OF THE INVENTION

The invention relates generally to liquid petroleum hydrocarbon blends having improved thermal stability. In particular, the invention relates to the use of nanoscopic additives for chemical modification of aviation jet fuels to achieve high thermal stabilities.

Hydrocarbon liquids, such as distillate fuels (gasoline, diesel fuel, and jet fuel), kerosene, and solvents are known to undergo reactions in the presence of oxygen. These reactions, called autoxidation, increase with temperature and result in the formation of oxidized products (e.g., gums, tars, particulates) causing the fuel to fail under thermal stress.

Many attempts have been made to solve the problem of oxidation of liquid hydrocarbons. The introduction of additives into liquid hydrocarbons has been used successfully for many years. For example, see U.S. Pat. No. 5,382,266, which teaches the application of phosphine and phosphates to distillate fuels to prevent fuel degradation (color degradation, particulate formation, and/or gum formation), and U.S. Pat. No. 5,509,944 which discloses the stabilization of gasoline by adding effective amount of a primary antioxidant, such as phenylene diamine, a hindered monophenol, or mixtures of these, and a secondary antioxidant, such as dimethyl sulfoxide. The combination of phosphine and hindered phenols has been used as a stabilizer in thermoplastic polymers to prevent discoloration. See, U.S. Pats. No. 5,362,783. See also, U.S. Pat. No. 6,475,252 which discloses an additive composition comprising a hindered phenol, a peroxide decomposer, and a phosphine compound to prevent oxidation and peroxide formation.

The U.S. Air Force JP-8+100 program developed an additive package for jet fuel which significantly increases the thermal stability of the fuel, preventing the formation of deposits which result from fuel oxidation within aircraft fuel systems. See Heneghan, S. P., Zabarnick, S., Ballal, D. R., Harrison, W. E., J. Energy Res. Tech. 1996, 118, 170-179; and Zabarnick, S., and Grinstead, R. R., Ind. Eng. Chem. Res. 1994, 33, 2771-2777. The JP-8+100 jet fuel incorporates additives to provide thermal stability to 425° F. At high temperatures (>425°), the JP-8+100 additive package looses effectiveness either due to temperature induced failure of the active mechanisms or due to thermal degradation of the additive compounds themselves.

Thus, while laboratory testing and field implementation of JP-8+100 have been very successful at temperatures up to 425° F., application of similar additive technologies to achieve thermal stabilities on the order of 900° F. is considered unlikely. The difficulty does not lie in the approach—modifying a fuel through the addition of additives remains a cost-effective and efficient method for tailoring a fuel to specific temperature requirements. Rather, the difficulty lies in the fundamental limits imposed by high-temperature chemistry—fuel molecules decompose at high temperatures.

There remains a need for an improved jet fuel additive to inhibit the oxidation of the fuel at high temperatures (>425° F.).

SUMMARY OF THE INVENTION

Applicants have discovered an innovative approach to modifying fuel-chemistry that addresses these fundamental limits imposed by high-temperature chemistry. In particular, Applicant's approach utilizes nanoscopic core-shell material additives to produce high thermal stability in jet aviation fuels.

The nanometer dimensions of these core-shell material additives provide extremely large surface areas to promote chemical reactivity while permitting suspension in liquid fuels and providing unlimited access to all components of an aircraft fuel system. Core-shell technology involves additive encapsulation in a protective, fuel-mimicking shell material, providing a means to explore and exploit previously unavailable chemistries (e.g., highly reactive materials, unstable materials, or materials incompatible with the liquid hydrocarbon fuel environment.

The nanoscopic core-shell material additives are designed to achieve the maximum heat-load capacity or heat sink of a typical middle-distillate kerosene-aviation fuel, e.g., (Jet A/A-1, JP-8 type fuel). This maximum value is defined by the onset of pyrolysis (the breaking of carbon-carbon bonds due to thermal excitation) which occurs at ~900° F. Current heat-sink capabilities are constrained by thermal-oxidative-decomposition processes, limiting fuel temperatures to 325° F. for JP-8 and 425° F. for JP-8+100 for full life (2000+ hrs). The heat sinks obtained at these temperatures are shown in Table 1 below. The ability to take the fuel to 900° F. would provide a heat-sink advantage that is an approximate five-fold increase over JP-8 (Table 1). Such a capability is critical to enabling Mach 4 speeds.

TABLE 1

Heat Sink Capabilities of Typical Middle-Distillate Kerosene Aviation Fuels

| Fuel Temp (° F.) | ΔH (btu/lb)[a] | heat-sink advantage |
|---|---|---|
| 325 | 125 | 1 |
| 425 | 190 | 1.5 |
| 900 | 590 | 4.7 |

[a]referenced against heat sink at 100° F.

In order to meet the primary goal of maximum heat sink from a typical kerosene jet aviation fuel, Applicants devised a new approach to additive chemistry. Current methodologies utilize a "package" of organic compounds (Table 2), whose combined interactions are ill defined. At high temperatures (>425° F.), the current additive package looses effectiveness either due to temperature induced failure of the active mechanisms or due to thermal degradation of the additive compounds themselves. Alternative materials capable of withstanding the high temperatures and capable of maintaining their activity are needed to achieve a fuel with thermal stabilities on the order of 900° F. (i.e., JP-900).

Nanomaterials show great potential in filling this role. Because of the very small size of these novel materials (diameters ranging from ~1 to ~100 nm), very high surface areas are obtained which enhance chemical reactivity, unlimited access to the aircraft fuel system is achieved, and materials normally incompatible with the chemical environment of aviation fuel can be made soluble or suspended easily, thus making available areas of chemistry previously unexplored (La, metal, semiconductor, and organometallic compounds). Numerous examples of these types of compounds are known to be stable at high temperature.

TABLE 2

Current Additives Used in Aviation Fuel.

| Fuel | Additives | $T_{max}$ |
|---|---|---|
| Jet A | NA | 325° F. |
| JP-8 | fuel system icing inhibitor<br>corrosion inhibitor<br>lubricity improver<br>anti-static additive | 325° F. |
| JP-8 + 100 | JP-8 additives +<br>dispersant<br>anti-oxidant<br>metal deactivator | 425° F. |

DETAILED DESCRIPTION

Figure 1:
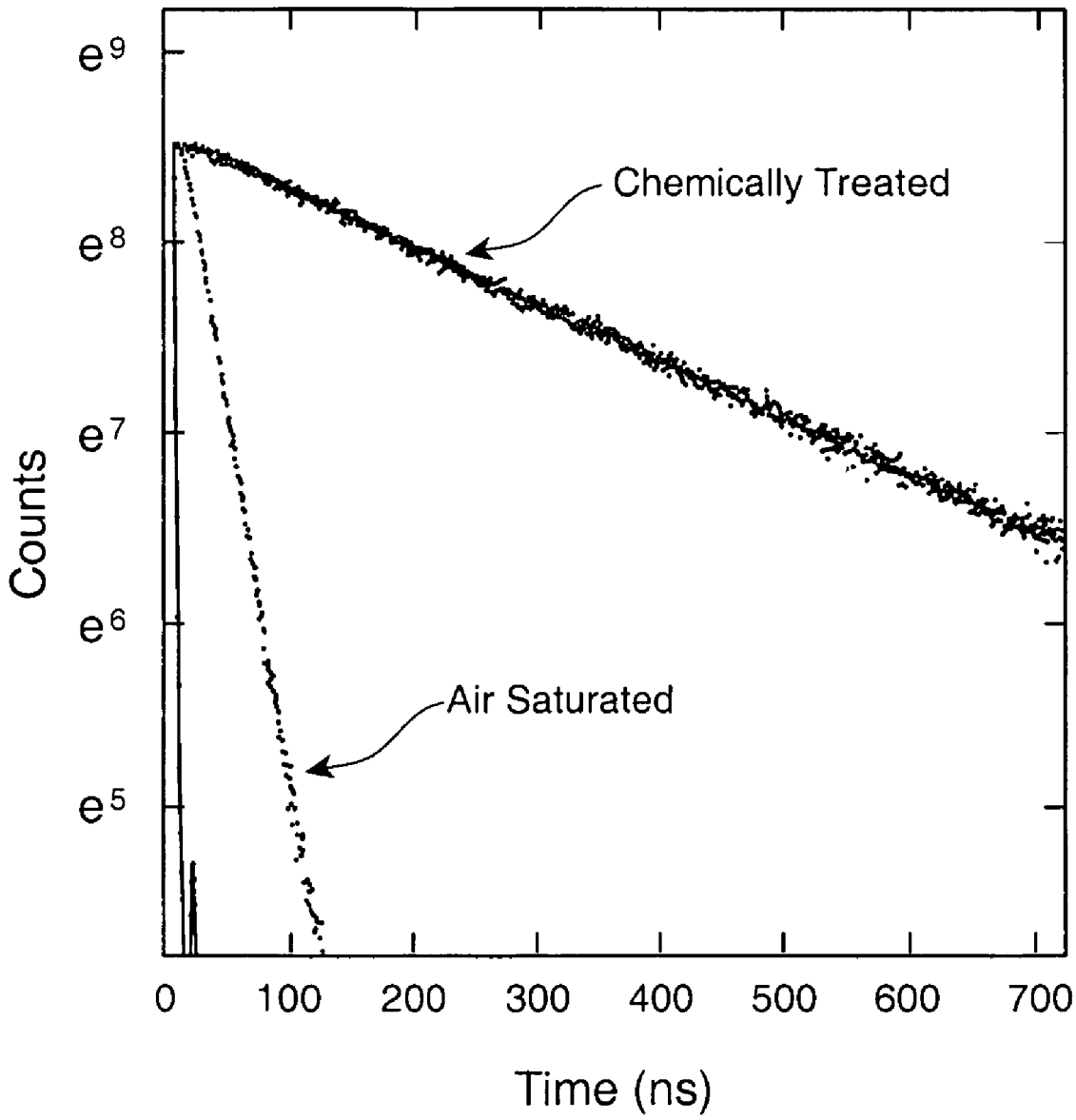
FIG. 1 is a plot of the fluorescence decays of pyrene in dodecane with and without $Fe^0$ nanoparticle additive.

The present invention utilizes nanoscopic core-shell material additives for high temperature jet aviation fuels. The nanometer dimensions of these core-shell additive materials provide extremely large surface areas to promote chemical reactivity while permitting suspension in liquid fuels and providing unlimited access to all components of an aircraft fuel system. Core-shell technology involves additive encapsulation in a protective, fuel-mimicking shell material. Materials capable of suppressing the chemical reactions that lead to poor thermal stability are likely to be highly reactive. It is therefore important that the reactive materials only be exposed to the fuel environment when needed so as to prevent the early consumption of the additive or minimize any detrimental effects.

This concept is referred to as protection and can be accomplished though the development of core-shell nanoparticles. In this case, the core is the highly reactive material needed to mitigate the targeted fuel reaction and the shell is ideally an inert coating that prevents interactions between the fuel and the core material. In addition, unprotected or uncoated nanoparticles are known to undergo several processes that contribute to long term instability (e.g., coagulation, precipitation, Ostwald ripening). It is important that the nanoadditives maintain their small size and chemical activity over prolonged periods of time to be consistent with fuel storage/logistics requirements.

Uncoated or unprotected nanomaterials suspended in aviation fuel will not remain in solution for long. The poor solubility of metal or organometallic particles in the non-polar hydrocarbon environment of the fuel will result in gradual precipitation. To avoid this phenomenon, the shell of the core-shell nanoparticle requires modification to make it soluble in the fuel environment. This can easily be accomplished through attachment of long-chain hydrocarbon molecules or through association with fuel-compatible oligomer or polymer molecules. The good solubility of the long-chain hydrocarbons or the polymers can then "carry" the nanoparticles into the fuel environment.

One of the most difficult challenges, the ability to release the reactive core material when and where it is needed will be critical to the development of JP-900. This capability requires the development of shell materials that are sensitive to the external environment; that is, materials that will alter their structure under some external perturbation. Applicant believes that temperature is the most likely trigger. Applicant has developed temperature sensitive nanoscopic materials that either decompose at elevated temperatures or become porous, allowing the fuel to interact with the reactive core material.

The present invention is a thermally stable fuel composition comprising a liquid hydrocarbon fuel selected from distillate fuels, kerosene and solvents, and a nanoscopic core-shell material additive. The additive comprises a core made of a reactive material, and a shell surrounding the core. The shell prevents interactions between the fuel and the reactive material until elevated temperatures are reached in the fuel composition.

Preferably, the nanoscopic core-shell material additive comprises from about 0.1% by weight or less of the fuel composition, more preferably from about 0.05% by weight or less of the fuel composition, most preferably from about 0.01% by weight or less of the fuel composition. The nanoscopic core-shell material additive is present in an amount necessary to be effective at chemical modification of aviation jet fuels to achieve high thermal stabilities. Preferably the nanoscopic core-shell material additive comprises at least about 0.001% by weight of the fuel composition.

Preferably, the nanoscopic core-shell material additive has a diameter of from 2 to about 100 nanometers, more preferably from about 2 to about 50 nanometers, most preferably from about 2 to about 10 nanometers.

The shell can be made of from a variety of organic materials such as carboxylic acids and surfactants. The shell prevents interactions between the fuel and the reactive material in the core until elevated temperatures are reached in the fuel composition. Preferably, the organic material is soluble in the liquid hydrocarbon fuel. Examples of preferred materials for the shell include oleic acid, linoleic acid, lauric acid, steric acid, SDS (sodium dodecyl sulfate), CTAB (hexadecyltrimethylammonium bromide), and Triton X (octylphenol ethoxylate).

Although the present invention can be used as an additive for a variety of liquid hydrocarbon fuels, preferably the fuel is a jet fuel, more preferably, a jet fuel intended for use at high temperatures.

The present invention also relates to a method for increasing the thermal stability of a fuel composition. The method comprises the steps of: providing a liquid hydrocarbon fuel and adding the nanoscopic core-shell material additive described above to the liquid hydrocarbon fuel.

The nanoscopic core-shell material additives materials used in the present invention can be made by a variety of well-characterized synthetic methods (see Table 3 below).

These methods include using reverse micelles as nanoreactors, acoustic cavitation induced by ultrasonic excitation, and the rapid expansion of a supercritical solution (RESS).

The reverse micelle method is perhaps the simplest of the three preparation methods due to the fact that no sophisticated equipment is required. The technique utilizes surfactants at concentrations above the CMC (critical micelle concentration) to form stable aggregates of well-defined structure. Owning to the nature of the surfactant molecule, a reverse micelle forms a structure characterized by an internal hydrophilic core with the hydrophobic tails of the surfactant molecules extending out into the non-polar solvent. This results in a polar core that has nanometer dimensions suspended in a non-polar solvent. Because the micelle is an aggregate as opposed to a polymer molecule, exchange of the contents of the polar cores between individual micelles in solution occurs easily and rapidly.

By controlling concentration ratio of water to surfactant one can control the size of the nanoreactor and thus the size of the particles formed. By changing the chemical reactant in the two separate reverse micelle solutions, one can control the chemistry of the particles formed. In addition, continued reaction of the completed particles with a third solution can result in the formation of a shell with a different chemical identity. Thus, the reverse micelle method offers a versatile and simple procedure for preparing nanomaterials, including core-shell particles.

Sonochemistry is a technique based on the formation of microcavities through the input of ultrasonic energy in solution. The cavitation process results in localized heating where temperatures have been reported as high as 5000K and cooling rates on the order of $10^{10}$ K/sec. According to the most current theory for nanoparticle formation by sonochemical means, volatile precursors collect in the short lived high temperature caviation regions, labile ligands are stripped away, and the remaining atoms (usually metals) agglomerate during the cooling process to form nanoparticles. The technique is ideally suited to the formation of zero valence metals with appropriate organometallic precursors. For example;

$$Fe(CO)_5+(\text{sonic energy})\rightarrow Fe^0+5CO \quad (1)$$

where the above reaction is carried out in dry dodecane and produces iron nanoparticles with diameters of ~8 nm. Solution-based coating of these particles can then be performed, resulting in either individually coated particles or larger agglomerates, also coated. Through proper selection of the coating material, chemical reactivity can be tuned. An experimental procedure for the synthesis of $Fe^0$ nanoparticles using Sonchemistry is described in "Low-Temperature Stability and High-Temperature Reactivity of Iron-Based Core-Shell Nanoparticles" Christopher E. Bunker and John J. Karnes, J. Am. Chem. Soc. 2004, 126 10852-10853, incorporated by reference herein.

A third technique that offers greater versatility than the two above mentioned methods is RESS (Rapid Expansion of a Supercritical Solution). This technique utilizes the enhanced solvation properties of high-density supercritical fluids to solvate materials at high concentrations in a fluid under high pressure. The nanoparticles are formed when this fluid is expanded into a region of lower pressure. Because of the rapid change in pressure, the solubility of the dissolved material decreases sharply inducing precipitation. The RESS process results in small nanoparticles with narrow size distributions. Some control over size and size distribution can be obtained through manipulation of the expansion parameters (flow rate, pressure, and temperature) and initial fluid conditions (density, fluid identity, and concentration of analyte). Greater control and versatility can be obtained with a modification of the RESS process to expand the fluid into a receiving solution (RESSolve). In this case, the mechanism for particle formation remains the same; however, the addition of the receiving solvent allows for secondary reactions in solution (e.g., reductions, bimolecular reactions, and core-shell type reactions).

TABLE 3

Nanomaterial Preparation Capabilities.

| Method | Mechanism | Capability |
|---|---|---|
| Reverse Micelle | confined-space reaction | metal reductions: $A^{n+} \rightarrow A^\circ$<br>multicomponent reactions: $A + B \rightarrow AB$<br>core-shell structures: $A^{n+} \rightarrow A^\circ + B \rightarrow B(A^\circ)$ |
| Sono-chemical | nanometer sized high-temperature reaction zone | metal reductions: $A^{n+} \rightarrow A^\circ$<br>degradation and nucleation: $AB \rightarrow A^\circ$ |
| RESS[a] | precipitation through rapid depressurization | metal reductions: $A^{n+} \rightarrow A^\circ$<br>multicomponent reactions: $A + B \rightarrow AB$<br>mixed metals of non-equilibrated compositions: $A_mB_n$ |
| RESSolve | modified to include expansion into a receiving solution | metal reductions: $A^{n+} \rightarrow A^\circ$<br>multicomponent reactions: $A + B \rightarrow AB$<br>mixed metals of non-equilibrated compositions: $A_mB_n$ |

[a]Rapid Expansion of a Supercritical Solution

These nanoparticles were shown to effectively remove dissolved oxygen from a hexane solution:

$$Fe^0+O_2\rightarrow Fe_2O_3 \quad (2)$$

where $Fe^0$ is in the form of a nanoparticle and $Fe_2O_3$ is formed on the surface of that particle. The reaction was monitored using the fluorescence lifetime of pyrene as an indicator. This process is shown in FIG. 1 where the fluorescence decays of pyrene in dodecane with and without $Fe^0$ particles are shown. The short decay (lifetime ~20 ns) indicates air saturated, and the long decay (lifetime ~450 ns) indicates no oxygen in solution. The decays are plotted on a natural log scale. The shorter lifetime is due to the efficient bimolecular quenching reaction that occurs between pyrene and oxygen. The following non-limiting examples illustrate the invention:

EXAMPLE 1

Synthesis $Fe^0$ Nanoparticles with Organic Coating and Reaction in Air Saturated Dodecane Using the sonochemical method, a core-shell version of the $Fe^0$ nanoparticle additive was prepared with oleic acid serving as the shell material.

A dodecane solution coating ~$8\times10^{-3}$ M oleic acid was prepared in a 100 ml vacuum flask. The solution was then deoxygenated by the freeze-pump-thaw procedure, repeating the procedure at least five times. To a sonochemical reaction flask is added 14 ml of the de-oxygenated dodecane/oleic acid solution. The solution was then bubbled with dry nitrogen gas. 200 mL of $Fe(CO)_5$ was then added to the dodecane/oleic acid solution. Acustic energy was than applied in a 1 second on, 1 second off pattern for a total time of 30 min. The input energy per pulse was adjusted to be ~22 W. Within five minutes, the reaction solution begins to show signs of reaction, turning dark brown to black. Upon completion of the reaction, the product is recovered by evaporating the dodecane under vacuum and heat (~90° C.). The solid that is obtained is waxy and brown in color. Characterization of the solid shows it to be zero valent iron nanoparticles of ~8 nm diameter, with a shell consisting of oleic acid.

Figure 2:
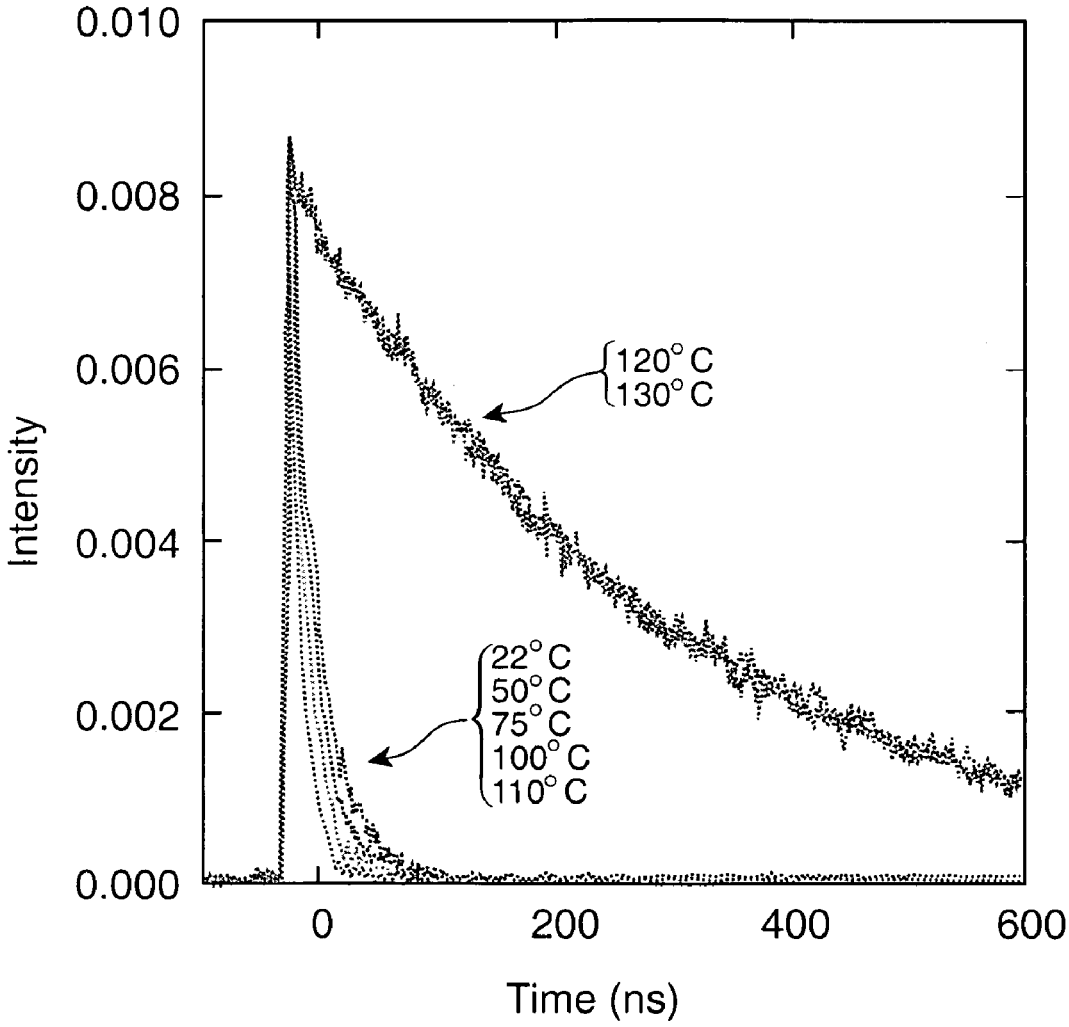
FIG. 2 is a plot of the fluorescence decays of pyrene recorded as a function of temperature in air saturated dodecane in the presence of $Fe^0$ nanoparticles with an organic coating.
Figure 3:
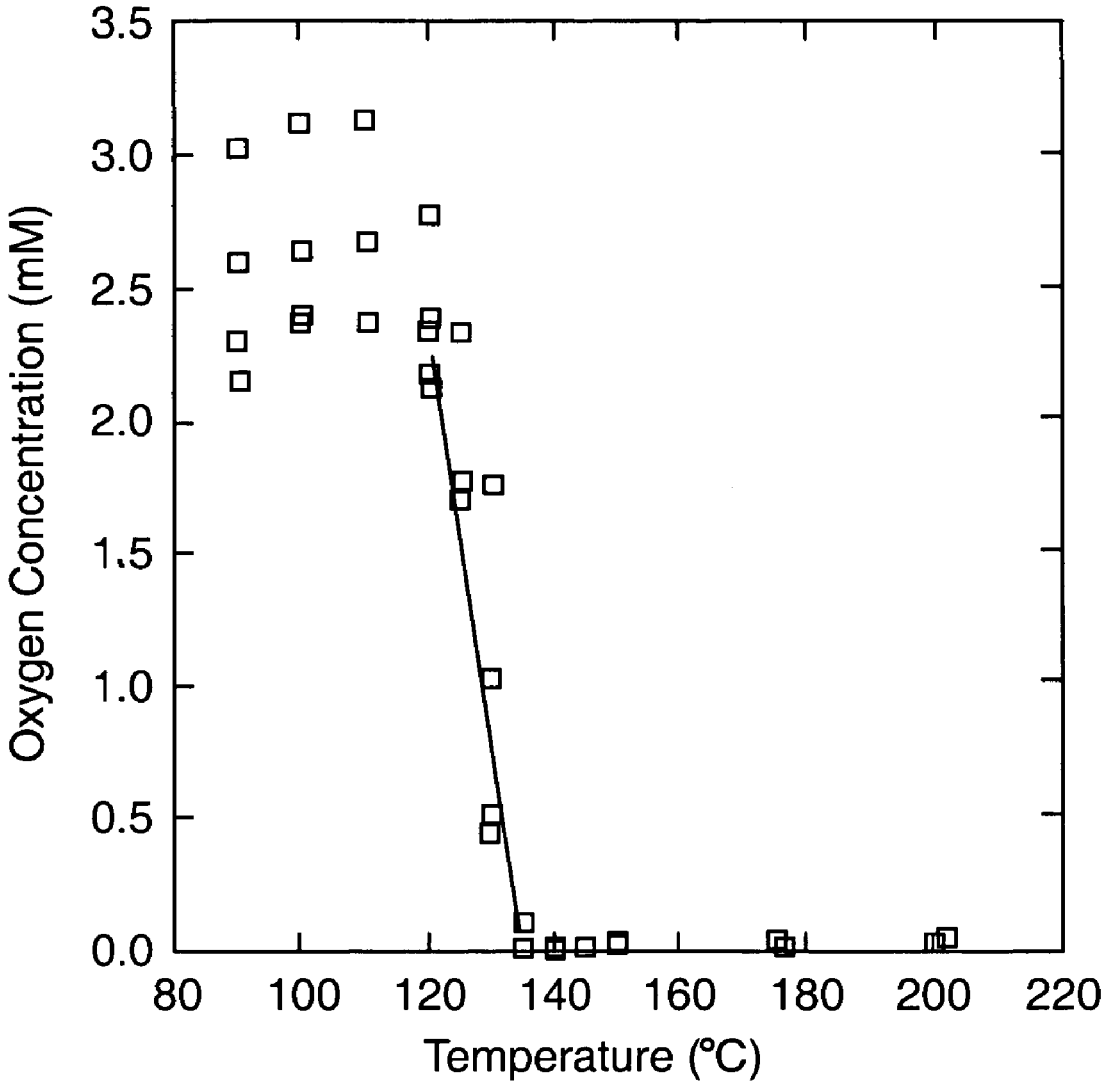
FIG. 3 is a plot of oxygen concentration vs. reaction temperature in air saturated dodecane in the presence of $Fe^0$ nanoparticles with an organic coating.

At room temperature, the additive is stable and shows no indication of reactivity (see FIG. 2). Again, this was monitored using the bimolecular quenching reaction of pyrene with oxygen. The stability/reactivity of the additive was measured as a function of temperature from room temperature to 130° C. (266° F.). In the temperature range of 110 to 120° C. (230 to 248° F.) the lifetime of pyrene was seen to increase to its full value, indicating the consumption of oxygen by the iron nanoparticle (eq. 2 above). The results show that the organic coating successfully protects the reactive material at low temperatures and also successfully releases the reactive material at an elevated temperature. FIG. 3 shows a plot of oxygen concentration vs. reaction temperature for the same nanoparticle additive. Again, there is a clear transition at ~120° C. that leads to no oxygen present in solution above ~140° C. The loss of oxygen only occurs in the presence of the nanoparticle additive.

EXAMPLE 2

Reaction of $Fe^0$ Nanoparticles with Organic Coating in QCM

Figure 4A:
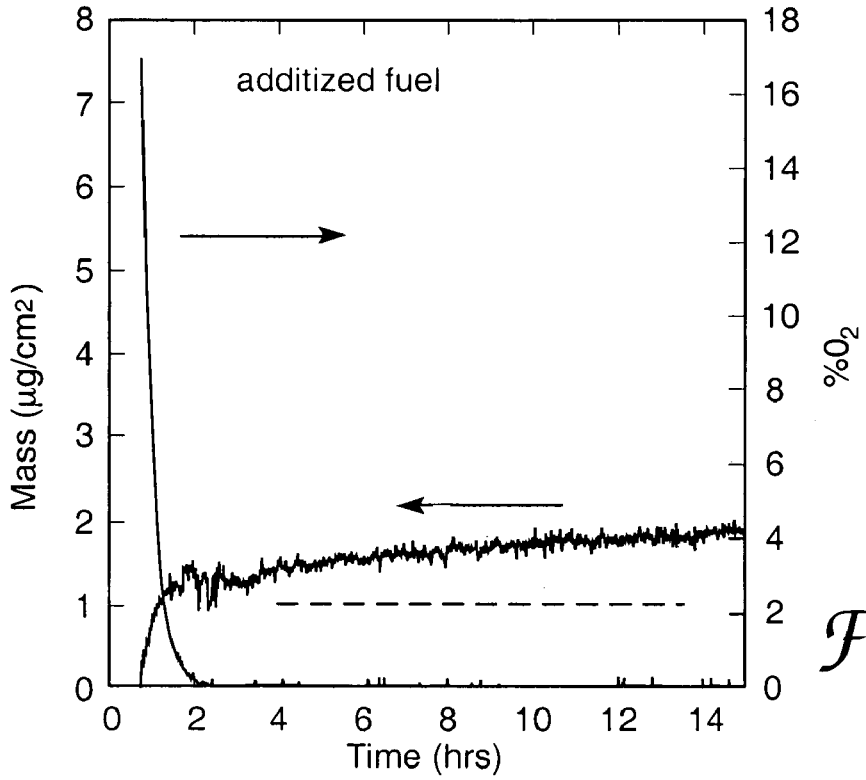
FIG. 4*a* is a plot of QCM data for JP-8 fuel with the $Fe^0$ nanoadditive with organic coating.
Figure 4B:
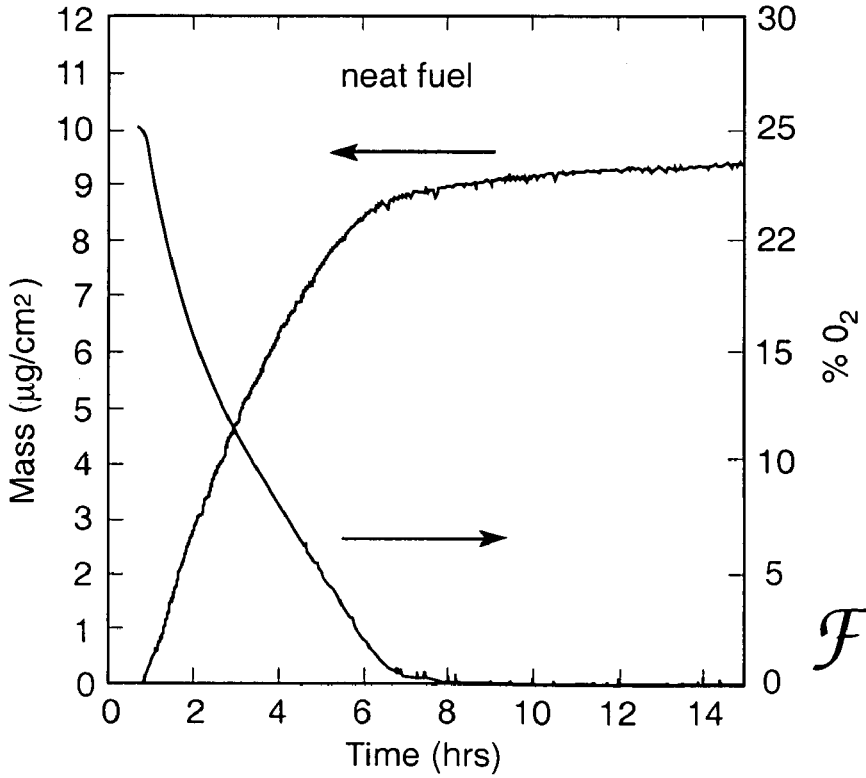
FIG. 4*b* is a plot of QCM data for unadditized JP-8 fuel.

To compare the response of this additive to JP-8+100, the current high thermal stability fuel of the U.S. Air Force, this additive ($Fe^0$ nanoparticles with organic coating) was tested in a quartz crystal microbalance (QCM) that measures soot deposition and oxygen consumption at 140° C. in fuel under static conditions. The results of the nanoscopic core-shell material additive are shown in FIG. 4*a* while the results of a neat fuel are shown in FIG. 4*b*. In the QCM system, the nanoscopic core-shell material additive depletes oxygen very quickly and produces carbon deposits on the order of 2 $\mu g/cm^2$. These results are significantly different from the neat fuel which consumes oxygen at a much slower rate and produces a much higher level of carbon (~10 $\mu g/cm^2$). Interestingly, the low level of carbon formed with the additive is almost as good as that produced by the JP-8+100 additive package (~1 $\mu g/cm^2$).

Having described the invention in detail and by reference to preferred embodiments thereof, it will be apparent that modifications and variations are possible without departing from the scope of the invention defined in the appended claims.

What is claimed is:

1. A thermally stable jet fuel composition comprising:

a) a liquid hydrocarbon jet fuel selected from distillate fuels, kerosene and solvents; and b) a nanoscopic core-shell material additive, wherein said additive comprises a core made of a reactive material, and a shell surrounding the core, wherein said shell prevents interactions between the fuel and the reactive material until elevated temperatures in the range of from 110° C. to 120° C. are reached in the fuel composition, wherein said nanoscopic core-shell material additive has a diameter of from 1 to about 100 nanometers, wherein said core is made from reactive nanoscopic zero valence $Fe^0$ particles, and wherein said shell comprises oleic acid.

2. A method for increasing the thermal stability of a jet fuel composition comprising the steps of:

a) providing a liquid hydrocarbon jet fuel selected from distillate fuels, kerosene and solvents; and b) adding a nanoscopic core-shell material additive to the liquid hydrocarbon fuel, wherein said additive comprises a core made of a reactive material, and a shell surrounding the core, wherein said shell prevents interactions between the fuel and the reactive material until elevated temperatures in the range of from 110° C. to 120° C. are reached in the fuel composition, wherein said nanoscopic core-shell material additive has a diameter of from 1 to about 100 nanometers, wherein said core is made from reactive nanoscopic zero valence $Fe^0$ particles, and wherein said shell comprises oleic acid.

* * * * *